US011411294B2

(12) United States Patent
Ding et al.

(10) Patent No.: US 11,411,294 B2
(45) Date of Patent: Aug. 9, 2022

(54) CEILING ANTENNA

(71) Applicant: KUNSHAN HAMILTON COMMUNICATION TECHNOLOGY CO., LTD, Kunshan (CN)

(72) Inventors: Juntao Ding, Kunshan (CN); Zhaoying Song, Kunshan (CN); Jiexiang Wang, Kunshan (CN); Wenkai Luo, Kunshan (CN); Lu Zhang, Kunshan (CN)

(73) Assignee: KUNSHAN HAMILTON COMMUNICATION TECHNOLOGY CO., LTD, Kunshan (CN)

( * ) Notice: Subject to any disclaimer, the term of this patent is extended or adjusted under 35 U.S.C. 154(b) by 27 days.

(21) Appl. No.: 16/493,709

(22) PCT Filed: Oct. 12, 2017

(86) PCT No.: PCT/CN2017/105801

§ 371 (c)(1),
(2) Date: Sep. 12, 2019

(87) PCT Pub. No.: WO2018/166193

PCT Pub. Date: Sep. 20, 2018

(65) Prior Publication Data

US 2020/0036075 A1 Jan. 30, 2020

(30) Foreign Application Priority Data

Mar. 14, 2017 (CN) ..... 201710149998.5

(51) Int. Cl.
*H01Q 1/00* (2006.01)
*H01Q 1/12* (2006.01)
(Continued)

(52) U.S. Cl.
CPC ..... *H01Q 1/007* (2013.01); *H01Q 1/12* (2013.01); *H01Q 1/36* (2013.01); *H01Q 5/25* (2015.01); *H01Q 9/28* (2013.01)

(58) Field of Classification Search
CPC ..... H01Q 1/007; H01Q 1/12; H01Q 1/36; H01Q 1/2291; H01Q 9/28; H01Q 1/1221; H01Q 9/27
(Continued)

(56) References Cited

U.S. PATENT DOCUMENTS 3,778,839 A * 12/1973 Kovar ..... H01Q 11/083 343/772
3,942,180 A * 3/1976 Rannou ..... H01Q 9/28 343/725
(Continued)

FOREIGN PATENT DOCUMENTS

CN 203339291 12/2013
CN 203760634 8/2014
(Continued)

OTHER PUBLICATIONS

PCT Search Report for PCT/CN2017/105801 filed on Oct. 12, 2017 entitled Ceiling Antenna in the name of Kunshan Hamilton Communication Technology Co., Ltd; dated Jan. 3, 2018 (4 pages).

*Primary Examiner* — Andrea Lindgren Baltzell
*Assistant Examiner* — Yonchan J Kim
(74) *Attorney, Agent, or Firm* — Joseph A. Andelin; Fish IP Law, LLP

(57) ABSTRACT

A ceiling antenna includes a first antenna element, a second antenna element, a base plate, a spiral tail and a feeder. The second antenna element is fixedly connected to the first antenna element. The second antenna element is fixed to the base plate. The spiral tail is disposed around the edge of the second antenna element and provided with a notch. The feeder is connected to the first antenna element and the second antenna element, and feeds the first antenna element and the second antenna element.

13 Claims, 3 Drawing Sheets

(51) Int. Cl.
*H01Q 1/36* (2006.01)
*H01Q 9/28* (2006.01)
*H01Q 5/25* (2015.01)

(58) Field of Classification Search
USPC ..... 343/895
See application file for complete search history.

(56) References Cited

U.S. PATENT DOCUMENTS

| | | | | |
|---|---|---|---|---|
| 6,369,766 | B1 * | 4/2002 | Strickland | H01Q 1/007 343/713 |
| 7,486,251 | B2 | 2/2009 | Chan | |
| 7,889,151 | B1 * | 2/2011 | Brock | H01Q 1/38 343/895 |
| 2011/0063182 | A1 * | 3/2011 | Sanford | H01Q 19/00 343/846 |
| 2014/0118209 | A1 * | 5/2014 | Yona | H01Q 9/40 343/775 |
| 2016/0226145 | A1 * | 8/2016 | Xu | H01Q 9/0464 |

FOREIGN PATENT DOCUMENTS

| | | |
|---|---|---|
| CN | 203871465 | 10/2014 |
| CN | 106329078 | 1/2017 |
| CN | 106785380 | 5/2017 |
| JP | 2011082810 | 4/2011 |

* cited by examiner

CEILING ANTENNA

The present application is a national stage application under 35 U.S.C. 371 based on international patent application PCT/CN2017/105801, filed on Oct. 12, 2017 which claims the priority of Chinese patent application No. 201710149998.5 filed on Mar. 14, 2017 to the CNIPA, disclosures of both of which are incorporated in the present application by reference in their entireties.

TECHNICAL FIELD

The present embodiment relates to the field of antenna technologies, for example, to a ceiling antenna.

BACKGROUND

With the arrival of the age of the 4th generation mobile communication technology (4G) and the 5th generation mobile communication technology (5G), data in a request is larger and larger, so the bandwidth of the communication system in the age of the 3rd generation mobile communication (3G) is unable to meet communication requirements in the future. The system needs broader bandwidth, and accordingly the bandwidths of various antennas also are required to be expanded. At the same time, a request for coverage of Wireless-Fidelity (Wi-Fi) in various occasions is more and more popular. To save resources and reduce difficulties in network installation, multiple operators share the network. In this way, the system needs a broader frequency band. Meanwhile, for system expansion in the future, network constructors hope to cover the coverage of Wi-Fi in the same network system, so operators urgently need an indoor coverage ceiling antenna.

The indoor coverage ceiling antennas according to the related art have a frequency band of 698-2700 MHz, and are substantially uniform in principle. Limited by the principle, the indoor coverage ceiling antennas all have a relatively large size.

SUMMARY

For above technical problems, the present embodiment provides a ceiling antenna whose height and diameter are both reduced.

The present embodiment provides a ceiling antenna. The ceiling antenna includes an upper cone, a lower cone, a support member, a plurality of support rods, a base plate, a spiral tail and a feeder.

The support member and the base plate are both ring-shaped. The support member is connected to the base plate by the plurality of support rods. The plurality of support rods is disposed around the periphery of the support member. The upper cone and the lower cone are both conical, the top portion of the upper cone is fixedly connected to the support member downwardly, and the top portion of the lower cone is fixedly connected to the base plate upwardly. The spiral tail extends outward around the lower edge of the lower cone.

The feeder passes through the hollow portion of the base plate and feeds the upper cone and the lower cone.

A ceiling antenna includes a first antenna element, a second antenna element, a base plate, a spiral tail and a feeder.

The second antenna element is fixedly connected to the first antenna element.

The second antenna element is fixed to the base plate.

The spiral tail is disposed around the edge of the second antenna element and provided with a notch.

The feeder is connected to the first antenna element and the second antenna element and feeds the first antenna element and the second antenna element.

In an embodiment, the notch penetrates the spiral tail and divides the spiral tail into a plurality of spiral tail units.

In an embodiment, the notch is arc-shaped so that each spiral tail unit is a fan blade extending outward around the second antenna element.

In an embodiment, the notch is a slit gradually enlarged along a direction in which the spiral tail extends.

In an embodiment, the spiral tail is provided with a first folding-up portion perpendicular to a preset surface of the base plate and a second folding-up portion joined to the first folding-up portion and parallel to the preset surface of the base plate, wherein the preset surface of the base plate is a surface, on which the second antenna element is disposed, of the base plate.

In an embodiment, the second antenna element is a cone with an opening disposed toward the base plate.

In an embodiment, the second antenna element is integrally formed with the spiral tail or is fixed to the spiral tail by a connector.

In an embodiment, the notch penetrates the spiral tail and a portion of the second antenna element.

In an embodiment, the first antenna element is a cone with an opening disposed away from the second antenna element, and a cone top of the first antenna element and a cone top of the second antenna element are disposed adjacent to each other.

In an embodiment, the feeder penetrates the base plate, and one end of the feeder is fixedly connected to the first antenna element and the second antenna element.

In an embodiment, the ceiling antenna further includes a support member and a plurality of support rods, wherein the support member is ring-shaped and disposed around the first antenna element, and the support member is connected to the base plate by the plurality of support rods distributed in a circumferential direction.

In an embodiment, the base plate is uniformly provided with a plurality of screw holes for fixedly connecting the base plate to the second antenna element.

In an embodiment, an inner side of a circumference of the support member is uniformly provided with a plurality of stop blocks configured to fixedly connect the first antenna element.

In an embodiment, the base plate is ring-shaped.

The ceiling antenna according to the present embodiment achieves reduction in both height and diameter, and thereby achieves the miniaturization of the ceiling antenna.

DETAILED DESCRIPTION

Figure 1:
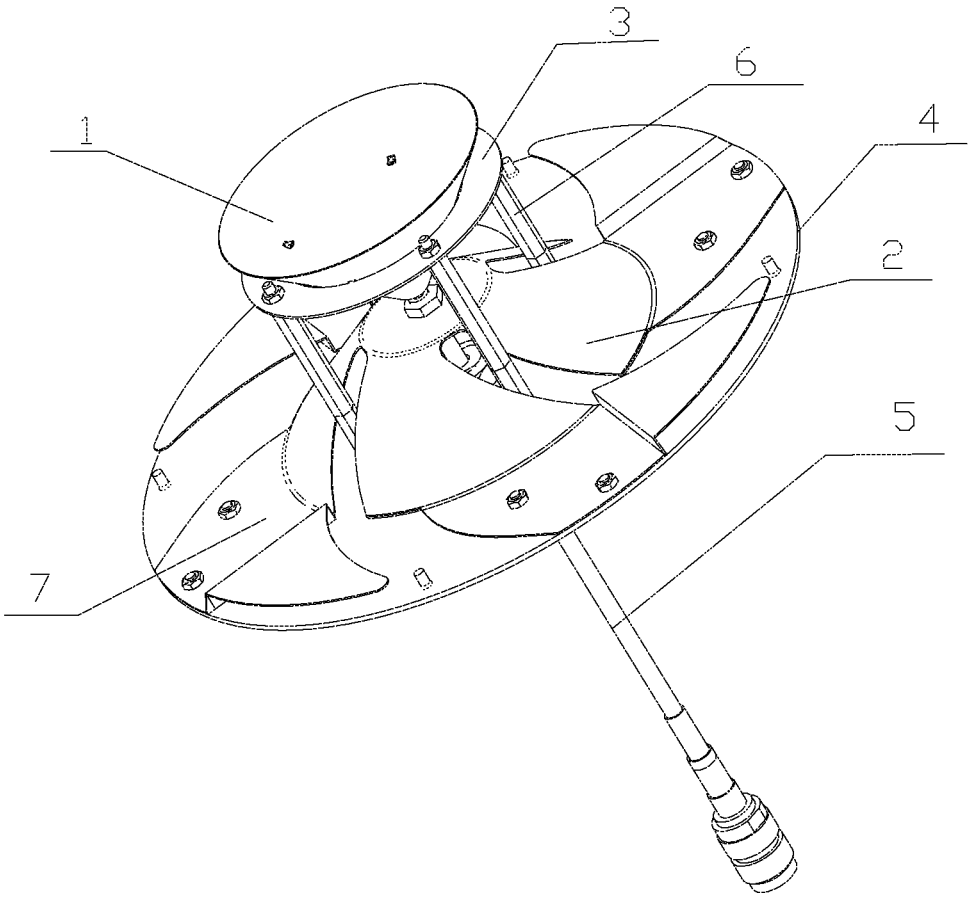
FIG. 1 is a perspective view of a ceiling antenna according to the present embodiment.

Hereinafter the present disclosure will be described in detail in conjunction with the drawings and embodiments. It should be understood that, the specific embodiments set forth below are merely intended to illustrate and not to limit the present disclosure. It is to be noted that to facilitate description, only part, not all, of structures related to the present disclosure are illustrated in the accompanying drawings.

The indoor coverage ceiling antennas according to the related art are either small in diameter and high in height, or large in diameter and low in height. It is difficult to reduce both the height and the diameter.

The present embodiment provides a ceiling antenna. The ceiling antenna includes a first antenna element, such as an upper cone 1; a second antenna element, such as a lower cone 2; a base plate 4; and a feeder 5. The ceiling antenna can be configured for indoor signal coverage.

The upper cone 1 is made of an electrical conducting material and is conical in shape. Relative to the lower cone 2, the upper cone is less in cone height and less in bottom circle radius. In an assembled state, a top of the upper cone 1 is fixedly connected downwardly on a support member 3.

Figure 2:
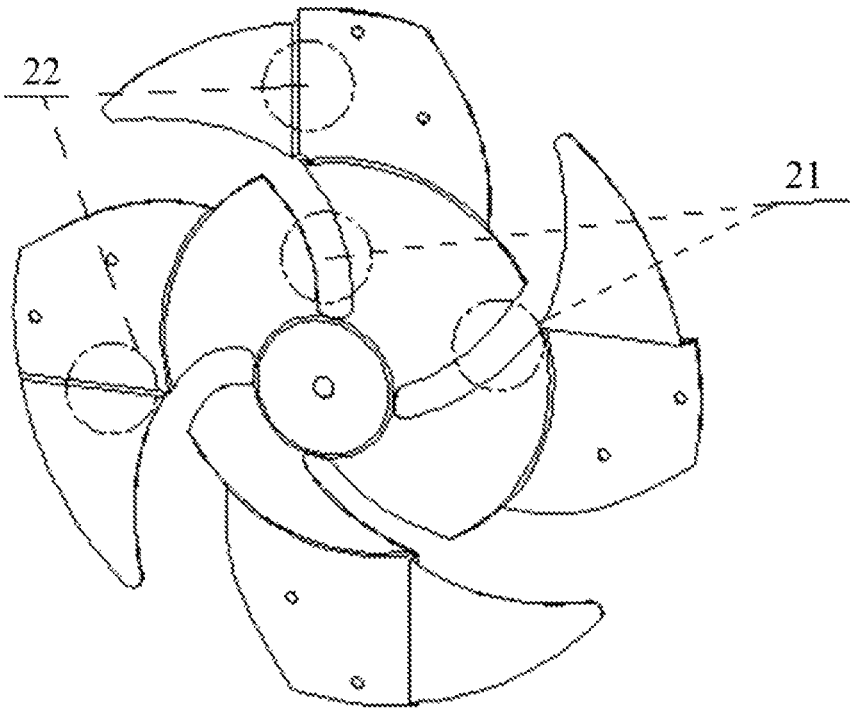
FIG. 2 is a perspective view of a lower cone according to the present embodiment.
Figure 3:
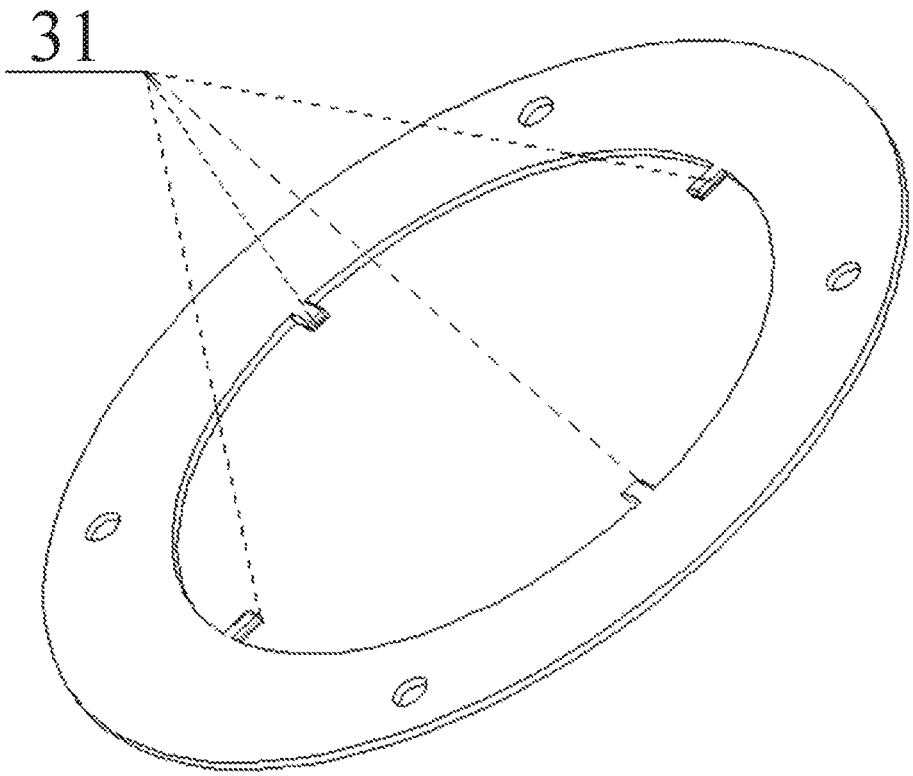
FIG. 3 is a perspective view of a support member according to the present embodiment.

The lower cone 2 is also made of an electrical conducting material and is approximately conical in shape. FIG. 2 shows a perspective view of the lower cone member 2. Referring to FIG. 2, the lower cone 2 is greater than the upper cone 1 in height and greater than the upper cone 1 in bottom circle radius. In addition, in an embodiment, a spiral tail 7 extending outward is disposed around a periphery of the lower cone 2. The spiral tail 7 is provided with a notch, and the notch penetrates the spiral tail 7 and divides the spiral tail 7 into a plurality of spiral tail units. In the present embodiment, the number of the spiral tail units disposed may be four. In an embodiment, the four spiral tail units are uniformly distributed around the periphery of the lower cone 2. The periphery refers to the outer side of the circumference of the lower cone 2. In an embodiment, each of the spiral tail units has a shape of a fan blade extending outward around the second antenna element.

A slit 21, that is, the notch, is disposed between different spiral tail units, and a gap of the slit 21 is gradually enlarged from the top to the periphery of the lower cone 2. That is, the slit has an involute shape. The slit 21 is wide enough so that a support rod can pass through the slit 21, and thereby the support rod can fixedly connect the support member 3 to the base plate 4. The principle of terminal capacity loading and terminal inductance loading can be achieved by disposing the slit 21 between adjacent spiral tail units and between adjacent lower cones 2, so that a bandwidth of the ceiling antenna can be well expanded without increasing the size of the ceiling antenna.

In an embodiment, a folding-up portion 22 is disposed on a tail section of each of the spiral tail units. Using a multi-layer no-coplanar structure, the folding-up portion 22 can increase an electrical length of the antenna without increasing the radius of the lower cone member, and thus, the space utilization is improved. The folding-up portion 22 disposed is of a great importance for the miniaturization of the antenna.

The spiral tail 7 disposed around the outer edge of the lower cone can increase the bandwidth of the ceiling antenna and facilitates performance improvement of the ceiling antenna.

In an embodiment, the ceiling antenna further includes a support member 3. The support member 3 may be made of a non-conducting hard material and is ring-shaped. The support member 3 is configured to support the upper cone 1. The support member 3 is fixedly connected to the base plate 4 by a plurality of support rods 6 connected to the base plate. The number of support rods 6 may be more than one, such as four. The connecting positions between the support rods 6 and the support member 3 may be uniformly distributed on the support member 3 in a circumferential direction of a ring shape of the support member 3.

Similar to the support member 3, the base plate 4 may also be made of a non-conducting hard material. The base plate is also ring-shaped. The base plate 4 is mainly configured to support the lower cone 2. In an embodiment, the base plate 4 is fixedly connected to the lower cone 2 by a plurality of screw holes disposed on the base plate 4.

In an embodiment, the non-conducting hard material may be Acrylonitrile Butadiene Styrene plastic (ABS) or FR4 composite material.

In an embodiment, a plurality of stop blocks 31 protrude from an inner side of a circumference of the support member 3. By the stop blocks, the support member is fixedly connected to the upper cone 1.

The feeder 5 is configured to feed the upper cone 1 and the lower cone 2. In the present embodiment, the feeder 5 passes through the center aperture of the base plate 4 and feeds the upper cone and the lower cone.

The ceiling antenna according to the present embodiment has a broad coverage bandwidth. The ceiling antenna may be an indoor coverage ceiling antenna covering 700-6000 MHz (megahertz) and having a frequency multiplying by 9, and can cover the frequency bands of mobile communication, Worldwide Interoperability for Microwave Access (wimax), Wi-Fi, Global Positioning System (GPS), BeiDou Navigation Satellite System (BDS) and so on.

What is claimed is:

1. A ceiling antenna, comprising:

a first antenna element;

a second antenna element fixedly connected to the first antenna element;

a base plate, wherein the second antenna element is fixed to the base plate;

a spiral tail, which is disposed around an edge of the second antenna element, provided with a notch, and functions as a third antenna element; and a feeder, which is connected to the first antenna element and the second antenna element and is configured to feed the first antenna element and the second antenna element; and wherein the notch is configured to penetrate the spiral tail and divide the spiral tail into a plurality of spiral tail units, and the notch is arc-shaped so that each of the plurality of spiral tail units is a fan blade which is plate-shaped and extends outward around the second antenna element so that omnidirectional radiation of signals is achieved;

wherein the first antenna element is a cone with an opening disposed facing away from the second antenna element, and a cone top of the first antenna element and a cone top of the second antenna element are disposed adjacent to each other.

2. The ceiling antenna according to claim 1, wherein the notch is a slit gradually enlarged along a direction in which the spiral tail extends.

3. The ceiling antenna according to claim 1, wherein the spiral tail is provided with a first bent portion perpendicular to a preset surface of the base plate and a second bent portion joined to the first bent portion and parallel to the preset surface of the base plate, wherein the preset surface of the base plate is a surface of the base plate on which the second antenna element is disposed, and the spiral tail is made of a conductive material.

4. The ceiling antenna according to claim 3, wherein the second antenna element is a cone with an opening disposed toward the base plate.

5. The ceiling antenna according to claim 4, wherein the second antenna element is integrally formed with the spiral tail or is connected to the spiral tail by a connector.

6. The ceiling antenna according to claim 5, wherein the notch is configured to penetrate the spiral tail and a portion of the second antenna element.

7. The ceiling antenna according to claim 1, wherein the feeder penetrates the base plate, and one end of the feeder is fixedly connected to the first antenna element and the second antenna element.

8. The ceiling antenna according to claim 7, further comprising a support member and a plurality of support rods, wherein the support member is ring-shaped and disposed around the first antenna element, and the support member is connected to the base plate by the plurality of support rods distributed in a circumferential direction of the support member.

9. The ceiling antenna according to claim 8, wherein the base plate is uniformly provided with a plurality of screw holes for fixedly connecting the base plate to the second antenna element.

10. The ceiling antenna according to claim 8, wherein an inner side of a circumference of the support member is uniformly provided with a plurality of stop blocks configured to fixedly connect the first antenna element.

11. The ceiling antenna according to claim 8, wherein the base plate is ring-shaped.

12. The ceiling antenna according to claim 2, wherein the spiral tail is provided with a first bent portion perpendicular to a preset surface of the base plate and a second bent portion joined to the first bent portion and parallel to the preset surface of the base plate, wherein the preset surface of the base plate is a surface of the base plate, on which the second antenna element is disposed.

13. A ceiling antenna, comprising:

a first antenna element;

a second antenna element fixedly connected to the first antenna element;

a base plate, wherein the second antenna element is fixed to the base plate;

a spiral tail, which is disposed around an edge of the second antenna element, provided with a notch, and functions as a third antenna element; and a feeder, which is connected to the first antenna element and the second antenna element and is configured to feed the first antenna element and the second antenna element;

wherein the notch is configured to penetrate the spiral tail and divide the spiral tail into a plurality of spiral tail units, and the notch is arc-shaped so that each of the plurality of spiral tail units is a fan blade which is plate-shaped and extends outward around the second antenna element so that omnidirectional radiation of signals is achieved;

wherein in order to increase an electrical length of the ceiling antenna, the spiral tail is provided with a first bent portion perpendicular to a preset surface of the base plate and a second bent portion joined to the first bent portion and parallel to the preset surface of the base plate, wherein the preset surface of the base plate is a surface of the base plate on which the second antenna element is disposed, and the spiral tail is made of a conductive material.

* * * * *